US008005577B2

(12) United States Patent
Wenzel et al.

(10) Patent No.: US 8,005,577 B2
(45) Date of Patent: Aug. 23, 2011

(54) APPARATUS FOR CONTROLLING THE MOVEMENT OF FURNITURE PARTS WHICH CAN BE MOVED WITH RESPECT TO ONE ANOTHER, AND PIECE OF FURNITURE

(75) Inventors: Holger Wenzel, Lindau (DE); Steffen Medebach, Wetzlar (DE); Frank Oberpichler, Giessen (DE)

(73) Assignees: Grass GmbH, Hochst (AT); Küster Automotive Door Systems GmbH, Ehringshausen (DE)

( * ) Notice: Subject to any disclaimer, the term of this patent is extended or adjusted under 35 U.S.C. 154(b) by 395 days.

(21) Appl. No.: 12/244,884

(22) Filed: Oct. 3, 2008

(65) Prior Publication Data

US 2009/0099706 A1 Apr. 16, 2009

Related U.S. Application Data

(63) Continuation of application No. PCT/EP2007/003027, filed on Apr. 4, 2007.

(30) Foreign Application Priority Data

Apr. 4, 2006 (DE) ..... 20 2006 005 580

(51) Int. Cl.
*G05D 1/02* (2006.01)

(52) U.S. Cl. ..... 700/302; 700/275

(58) Field of Classification Search ..... 700/302
See application file for complete search history.

(56) References Cited

U.S. PATENT DOCUMENTS

| | | | | |
|---|---|---|---|---|
| 6,685,288 | B1 | 2/2004 | MacMillan | 312/334.44 |
| 2004/0100169 | A1* | 5/2004 | Huber et al. | 312/319.5 |
| 2006/0261775 | A1* | 11/2006 | Huber et al. | 318/646 |

FOREIGN PATENT DOCUMENTS

| | | | |
|---|---|---|---|
| AT | 007 723 | U1 | 6/2005 |
| DE | 101 05 756 | A1 | 8/2001 |
| DE | 203 08 256 | U1 | 6/2004 |
| DE | 20 2004 007 170 | U1 | 9/2004 |
| DE | 20 2005 013 128 | U1 | 12/2005 |
| DE | 10 2004 045 568 | A1 | 3/2006 |
| DE | 20 2005 018 353 | U1 | 3/2006 |
| DE | 10 2004 045 567 | A1 | 4/2006 |
| DE | 20 2005 006 945 | U1 | 6/2006 |
| DE | 20 2006 002 103 | U1 | 8/2006 |
| DE | 20 2006 012 976 | U1 | 12/2006 |
| DE | 20 2006 012 656 | U1 | 2/2007 |
| DE | 20 2005 021 123 | U1 | 3/2007 |
| EP | 1 323 363 | A1 | 7/2003 |

(Continued)

*Primary Examiner* — Ryan A Jarrett
(74) *Attorney, Agent, or Firm* — Burr & Brown

(57) ABSTRACT

The invention relates to a device for controlling the movement of furniture parts which can be moved with respect to one another, having a drive unit by means of which a first furniture part can be moved in a driven manner relative to a second furniture part via a monitoring unit for monitoring the movement of the first furniture part. According to the invention, the monitoring unit is designed to record a movement pattern of the first furniture part if the moving first furniture part collides with an object, and to use this movement pattern as the basis for further monitoring of the movement of the first furniture part. A piece of furniture with a device according to the invention is also disclosed.

18 Claims, 1 Drawing Sheet

FOREIGN PATENT DOCUMENTS

| | | | |
|---|---|---|---|
| EP | 1 323 364 | A1 | 7/2003 |
| EP | 1 374 732 | A1 | 1/2004 |
| GB | 2 374 521 | A | 10/2002 |
| WO | 2004/100717 | A1 | 11/2004 |
| WO | 2004/100718 | A1 | 11/2004 |
| WO | 2005/058092 | A1 | 6/2005 |
| WO | 2005/079630 | A1 | 9/2005 |

* cited by examiner

APPARATUS FOR CONTROLLING THE MOVEMENT OF FURNITURE PARTS WHICH CAN BE MOVED WITH RESPECT TO ONE ANOTHER, AND PIECE OF FURNITURE

CROSS REFERENCE TO RELATED APPLICATIONS

This application is a continuation of International Application No. PCT/EP2007/003027, filed Apr. 4, 2007, which designated the United States, and claims the benefit under 35 USC §119(a)-(d) of German Application No. 20 2006 005 580.0, filed Apr. 4, 2006, the entireties of which are incorporated herein by reference.

FIELD OF THE INVENTION

The invention relates to a device for controlling the movement of furniture parts which can be moved with respect to one another, and to a piece of furniture including the device.

BACKGROUND OF THE INVENTION

Devices for controlling the movement of furniture parts which can be moved with respect to one another, having a drive unit for driven movement of a first furniture part relative to a second furniture part, are already known. If the movement of the first furniture part results in it colliding with an object, this can lead to undesirable consequences to the furniture part and to the object. In order to minimize or to avoid possible negative effects, the furniture part is, for example, moved such that it is driven comparatively very slowly and smoothly. In consequence, the movable furniture part can frequently not be used sufficiently quickly and effectively as desired.

SUMMARY OF THE INVENTION

The object of the present invention is to improve the options for use of devices as mentioned above in order to control the movement of furniture parts which can be moved with respect to one another, and to improve the operation friendliness of pieces of furniture provided with a corresponding device, without having to accept an increased risk of undesirable consequences of the movable furniture part colliding with an object.

The invention is first of all based on a device for controlling the movement of furniture parts which can be moved with respect to one another, having a drive unit by means of which a first furniture part can be moved in a driven manner relative to a second furniture part via a monitoring unit for monitoring the movement of the first furniture part. One major aspect of the invention is that the monitoring unit is designed to record a movement pattern of the first furniture part if the moving first furniture part collides with an object, and to use this movement pattern as the basis for further monitoring of the movement of the first furniture part. An immediate monitoring process can therefore be carried out in order to avoid undesirable effects resulting from the first furniture part colliding with the object. In addition, an assessment of possible consequences resulting from the collision of the relevant objects and possibly a person can be carried out and a subsequent action can be carried out on the basis of this. This is because it has been found that, advantageously, a conclusion about the nature of the collision or of the object which was previously unknown can advantageously be drawn by means of the movement pattern which can be recorded during a collision of the movable furniture part with an object. In particular, a valid assessment of the collision can be achieved with regard to potential hazards associated with this. This is advantageously possible, even at the moment of the collision, via the movement pattern of the first furniture part. In particular, very exact information about the movement pattern of the first furniture part at the moment of the collision or impact with an object can be obtained by means of a correspondingly designed monitoring unit, which operates with virtually no delay.

For example, a monitoring unit which, for example, may comprise a regulation and/or control unit, a microprocessor controller or a modern computation unit, can process, assess and if required store a relatively large amount of information within comparatively very short time intervals, and can initiate an appropriate action, likewise within a very short time, on the basis of this information. In particular, a respectively suitable measure with regard to the movement of the first furniture part can be initiated with the aid of the monitoring unit on the basis of the detected movement pattern on the collision of the first furniture part with an object, by means of which negative consequences resulting from the collision of the object under consideration can be minimized or virtually precluded.

In one advantageous embodiment of the invention, the monitoring unit is designed to record a movement pattern of the first furniture part during a closing movement of the first furniture part if the moving first furniture part collides with an object, and to use this movement pattern as the basis for further monitoring of the movement of the first furniture part. In particular, this makes it possible to provide trapping protection in which, for example, an object or for example a hand of a person is trapped between the front of the first furniture part and a body edge of the second furniture part, or a collision is initiated. If a collision is identified, once the movement of the first furniture part has been stopped, it is moved back or in the opening direction somewhat in order to safely preclude any touching between the trapped object and the first furniture part.

It is also possible that the monitoring unit is designed to use a movement pattern as the basis for distinguishing between a collision with an object and stopping of the movement of the first furniture part which has been deliberately initiated by an operator. This therefore allows on the one hand a high degree of control-friendliness to be achieved by an operator for the furniture parts, while on the other hand complying with the required relatively stringent safety demands. In general, this is a precondition for a wide range of devices under consideration since, for example, safety standards produced by the lawmakers must necessarily be complied with by devices and pieces of furniture equipped with a drive unit.

According to the invention, the distinction between an inadvertent collision and a desired movement stop results in a greater stimulus for the relevant device and a piece of furniture equipped with it. This is because the capability to stop the furniture part which can be moved in a driven manner, for example by hand, represents a very convenient and individual operation for the movable furniture part, for example in which the furniture part which is moved in a driven manner can be stopped in one of a large number of possible positions as desired by the operator. This can be done, for example, by hand or with some other body part. Furthermore, a precise stop position can advantageously be reached by the movable furniture part by a deliberately smooth action on the moving first furniture part. On the other hand, a collision with an object, for example with a small child or some other furniture part, can advantageously be reliably identified in terms of possible damage or risk of injury, and its consequences can be made considerably less serious. The proposed monitoring unit allows, so to speak, intelligent identification of and distinguishing between collision circumstances.

For example, according to the invention, comparatively rapid opening and closing of a movable furniture part, for example of a drawer, can be achieved according to the invention without any need to be concerned about negative effects in the event of a collision.

In one preferred embodiment of the invention, the monitoring unit is designed to evaluate signals, which can be detected by sensor means, in order to characterize the movement pattern. For example, when an electrical drive unit is present, the monitoring unit can distinguish the movement pattern virtually without any time delay, when the movable furniture part collides with an object, by means of the current which can be detected and is recorded by the drive unit. In addition, a multiplicity of further sensors and suitable signals which can be detected by sensors can be used to characterize the movement pattern of the first furniture part. For example, optical sensors may be used, for example with the aid of images which can be recorded by a camera, and/or mechanical, inductive and/or capacitive sensors, and/or appropriately generated signals can be evaluated in order to characterize the movement pattern.

In a further preferred embodiment of the invention, the monitoring unit is designed to evaluate pulses from an incremental transmitter in order to record the movement pattern, which incremental transmitter generates pulses as a function of the movement of the first furniture part. The movement of the movable furniture part can be characterized via an incremental transmitter by means of virtually any desired number of pulses produced in this case, thus allowing comparatively very precise assessment of the movement pattern of the first furniture part. For example, the number of pulses from the incremental transmitter which can be detected in a predetermined time window, for example in the order of magnitude of a fraction of a second, can be recorded and assessed in this time window.

The monitoring unit is advantageously designed to distinguish between a collision with an object and stopping of the movement of the first furniture part which has been deliberately initiated by an operator, on the basis of a comparison of the recorded pulses from the incremental transmitter per unit time with a reference value. The distinguishing process can be carried out in a valid form by means of the comparison of the detected pulses and/or of signals from the signaling devices mentioned as an alternative above with a corresponding reference value. By way of example, the reference value can be determined by results obtained on the basis of experiments, in which case a multiplicity of information items can be included in the reference value. If the first furniture part collides with an object, it is possible in this way, for example in the event of a relatively major reduction in the pulses in a predetermined time window in comparison to a comparison value or a threshold value, to deduce that the movable furniture part may have collided with a collision object. If a comparatively minor decrease in the detectable pulses from the incremental transmitter in contrast takes place in a time window under consideration, it is possible to deduce that a stop in the movement of the first furniture part has been initiated deliberately by an operator.

In a further advantageous embodiment of the invention, the monitoring unit is designed to stop the movement of the first furniture part after a collision of the moving first furniture part with an object. A movement stop or a possibly immediate stationary state of the movable furniture part makes it possible to reduce the disadvantageous consequences caused by the collision, or to virtually completely preclude them, in particular in a situation in which the movable furniture part collides with a person. If the monitoring unit and devices which interact with it to stop the movable furniture part are designed appropriately, it is advantageously possible to end the movement abruptly at the moment of the collision or, for example, within a fraction of a second after it.

It is particularly advantageous if the monitoring unit is designed to comparatively sharply decelerate the movement of the first furniture part after a collision with an object. This makes it possible to avoid or minimize undesirable or disadvantageous consequences caused by a collision of the movable furniture part with an object, for example a child or a person.

It is also advantageous if the monitoring unit is designed to relatively smoothly decelerate the movement of the first furniture part in order to stop the movement of the first furniture part which has been deliberately initiated by an operator. This can contribute to the operator being able to conveniently set up an exact setting for the stop position of the movable furniture part, because the movable furniture part is moving at a velocity which decreases moderately.

In a further advantageous embodiment of the invention, the monitoring unit is designed to move the first furniture part to a predetermined position after a collision with an object. The damage which may result from the collision can frequently be avoided, or at least kept within acceptable limits, by moving the movable first furniture part away from the collision object immediately after the collision. For example, this measure makes it possible to preclude a possible reason for injury caused by a first furniture part remaining, stopped, at the collision location. If the first furniture part is moved sufficiently far away from the collision location after the collision with the collision object, damage or injuries occurring after the actual collision as a result of the furniture part having been stopped or remaining in the collision position, can be avoided. The direction and magnitude of the predetermined position can be defined, depending on the setting.

The monitoring unit is particularly advantageously designed to stop the first furniture part after the collision with an object, and to move it to the predetermined position after a defined time interval has elapsed. This makes it possible to set up a time safety interval with regard to the collision after which, for example, a return is made once more to a normal operating state without any need for a deliberate action by a person.

In a further preferred embodiment of the invention, the monitoring unit is designed in particular to stop the first furniture part after a collision with an object, and to move the first furniture part to a closed position relative to the second furniture part. After a collision, this allows the first furniture part to be moved to its maximum pulled-in or its closed position, possibly after a time interval has elapsed, thus making it possible to preclude a further possible injury or damage potential by the first furniture part remaining open.

In an alternative advantageous embodiment of the invention, the monitoring unit is designed in particular to stop the first furniture part after a collision with an object, and to move the first furniture part to an open position relative to the second furniture part. This advantageously makes it possible to reduce or avoid possible undesirable or negative consequences of a collision. This is because, in certain circumstances, it is possible for the movement of the first furniture part to its open position following the collision to reduce the damage and thus to avoid a further potential hazard than would be the case if the first furniture part were to be locked in the collision position or to be moved to the closed position.

Furthermore, it is preferable if the monitoring unit is designed to move the first furniture part back through a predetermined movement distance, after a collision, in the opposite direction to the movement direction of the first furniture part before the collision, and to stop it there. Scenarios are conceivable in which it is advantageous for the movable furniture part to carry out a comparatively small backward movement after a collision in order, for example, to make the actual collision location accessible, although the furniture part is in particular not moved away through a greater distance, and in particular not as far as the closed or open position.

Furthermore, it is advantageous if the monitoring unit is designed to stop the first furniture part within a predetermined movement distance if the first furniture part collides with an object during an opening movement of the first furniture part from the closed position, and in particular to move it back to the closed position. For example, it is thus possible within a relatively short movement distance of a few centimeters away from the closed position of the first furniture part, for example of about 15 centimeters, to take account of the fact that it is improbable that a movement stop initiated deliberately by a user will occur in this movement range of the first furniture part. This is because a movable drawer, for example, can be operated, to be precise loaded or unloaded, by an operator only after the first furniture part has moved beyond the predetermined movement distance with a minimum distance to the closed position. Within the minimum distance of the drawer from the closed position, it can therefore generally be assumed that, if the drawer collides with an object, this will always be a collision with a certain damage or injury potential. It is therefore advantageous in any case to stop the drawer or the first furniture part and possibly to move it back somewhat, or to move it back to the closed position.

Finally, it is also proposed that the monitoring unit is designed to associate a collision of the movable first furniture part with an object within a predetermined movement distance exclusively with a stopping of the movement which has been deliberately initiated by an operator. If the moving first furniture part collides with an object, it may be possible to preclude a collision or to virtually preclude any disadvantageous effect when the movable furniture part collides with an object. This situation may apply in particular to subsections of the entire movement path of the movable furniture part.

The invention also relates to a piece of furniture having furniture parts which can be moved relative to one another, and having one of the above-mentioned devices. The advantages which can be achieved by the respective device can therefore be achieved for a piece of furniture with furniture parts which can be moved relative to one another. In particular, the pieces of furniture comprise movable furniture parts such as drawers, doors, hatches and the like which are guided in a moving manner via suitable guide devices on a second furniture part, in particular a furniture housing. In particular, guide rails may be used as guide devices for drawers and, in particular, fittings or hinges may be used as guide devices for doors or hatches.

BRIEF DESCRIPTION OF THE DRAWINGS

Further advantages and features of the invention will be explained in more detail with reference to the schematically illustrated figures, in which, in detail.

DETAILED DESCRIPTION OF THE INVENTION

Figure 1:
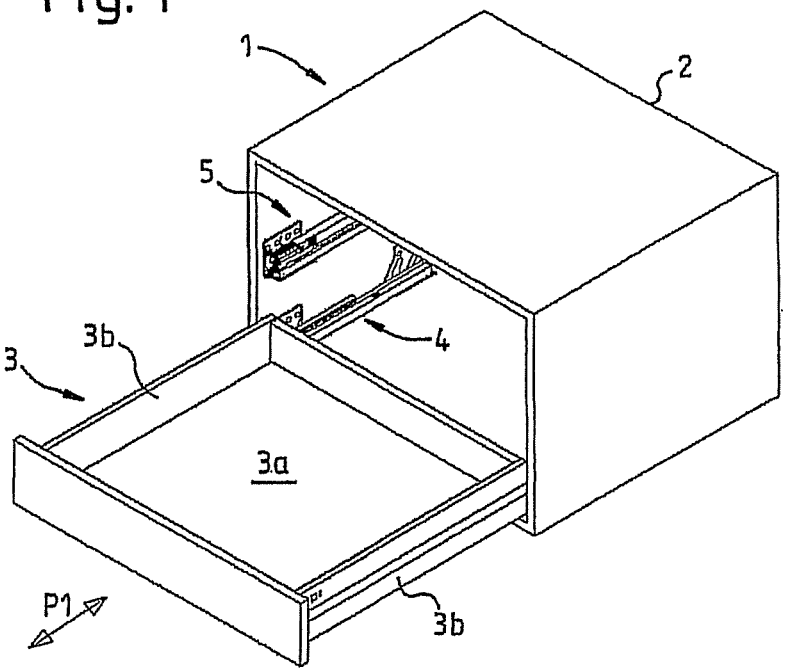
FIG. 1 shows a perspective view of a piece of furniture according to the invention with a drawer which can be moved in a housing.

FIG. 1 shows, obliquely from above, a piece of furniture 1 according to the invention with a housing 2 and a drawer 3 which is guided such that it can move in the housing 2. The drawer 3 which is arranged in the lower area of the housing 2 is illustrated in the open or pulled-out state, with the drawer 3 being movable with respect to the housing 2 by means of a pulling-out fitting or a drawer guide 4. A further drawer (not shown) can be accommodated in the housing 2 via a further drawer guide 5, in a manner corresponding to the drawer 3. The drawer 3 can be moved, to be precise pulled out or pushed in, relative to the housing 2 as indicated by the double-headed arrow P1. The drawer guide 4 is in each case fitted on the drawer side in the lower area of drawer frames 3*b* which project upwards on both sides on a drawer bottom 3*a* in order to hold and guide the movement of the drawer. Only the respective drawer guides 4 and 5 can be seen in FIG. 1, which are attached to the inside of a housing which can be seen. The drawer 3 can be moved in a driven manner, in which case the drive unit (not shown) can be arranged, for example, in the rear area of the housing or on the drawer guides 4, 5.

Figure 2:
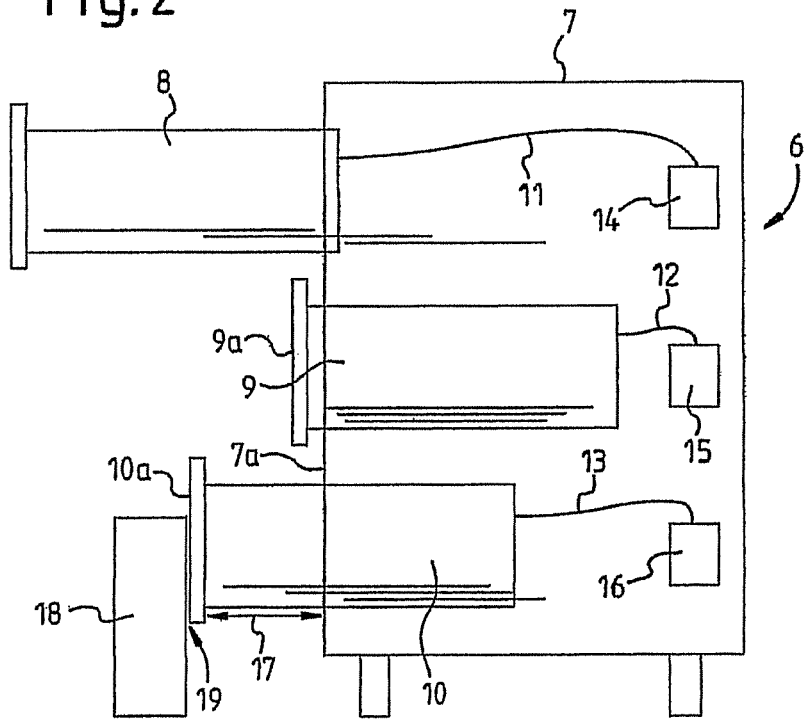
FIG. 2 shows a highly schematic section view from the side through a piece of furniture according to the invention with three drawers which can be moved in a driven manner in a housing.

FIG. 2 shows a highly simplified and schematic illustration in the form of a side view of a further piece of furniture 6 according to the invention with a housing 7, with one side wall of the housing 7 having been omitted. Three drawers 8, 9 and 10, which are arranged one above the other and can be moved in a driven manner are accommodated in the housing 7. The drawers 8, 9 and 10 are respectively connected via drive elements 11, 12 and 13 to drive units 14, 15, 16, which are respectively associated with one of the drawers 8-10. For this purpose, each of the drive elements 11-13 acts on the one hand on the respective drawer 8-10, or it parts, and on the other hand on the respective drive unit 14-16.

The drawer 8 is illustrated in a moved-out state with respect to the housing 7, or in an open position. The drawer 9 is located in a closed position, or is illustrated in a state in which it has been moved in the housing 7, with a drawer front 9*a* being positioned at a distance of up to 2 centimeters away from a front edge 7*a* of the housing, in order to allow the drawer 9 to be operated by means of a touch-latch system (not shown) or to be opened by pressing against the drawer front 9*a*. In order to open the drawer 9, it is moved through a short distance in the direction of the housing 7 by pressure on the drawer front 9*a*, as a result of which, after an initiation action, the drive unit 15 can move the drawer 9 forwards, in a driven manner, via the drive element 12.

The drawer 10 is moved out through part of the distance from the closed position, thus resulting in there being a distance 17 between a drawer front 10*a* and the front edge 7*a*. The drawer 10 is located in the state after a collision with an object, for example an object 18 in the form of a drinks case. When the drawer 10 was being moved out, a collision was identified and processed further on the basis of the movement pattern of the drawer 10 as detected when the collision occurred. In the situation illustrated in FIG. 2, damage to the object 18 and to the drawer 10 was avoided by immediately sharply stopping the drawer 10 at the moment of the collision, and in particular the object 18 was advantageously not knocked over, thus making it possible to preclude further damage caused by being knocked over. Furthermore, the drawer 10 was subsequently moved back through a small movement distance in the direction of the housing 7 after having been stopped, thus resulting in a short distance or small gap 19 between the drawer front 10*a* and the object 18.

A monitoring unit for monitoring the movement of the drawers 8-10 or individual monitoring units which communicate with one another and belong to each drawer 8-10, are not illustrated in FIGS. 1 and 2. However, by way of example, a monitoring unit can be accommodated in each of the drive units 14-16. In order, for example, to deliberately keep a drawer 8-10 in an extended position between a completely open position as shown in the case of the illustration of the drawer 8 and a closed position, for example as shown in the case of the illustration of the drawer 9, it is possible, for example, for an operator to manually push against this drawer during an opening movement of the relevant drawer or to let the drawer run into his hand, in which case this deliberately initiated collision of the relevant drawer and the operator's hand allows the monitoring unit to detect a movement pattern and to use this movement pattern as the basis for monitoring the movement of the relevant drawer. If the drawer is stopped deliberately, it can be decelerated smoothly to a stop position, for example within a few centimeters.

LIST OF REFERENCE SYMBOLS

1 Piece of furniture
2 Housing
3 Drawer
3*a* Drawer bottom
3*b* Drawer frame
4 Drawer guide
5 Drawer guide
6 Piece of furniture
7 Housing
7*a* Front edge
8 Drawer
9 Drawer
9*a* Drawer front
10 Drawer
10*a* Drawer front
11 Drive element
12 Drive element
13 Drive element
14 Drive unit
15 Drive unit
16 Drive unit
17 Distance
18 Object
19 Gap

We claim:

1. A device for controlling the movement of furniture parts which can be moved with respect to one another, comprising a drive unit by means of which a first furniture part can be moved in a driven manner relative to a second furniture part, and a monitoring unit for monitoring the movement of the first furniture part, wherein the monitoring unit records a plurality of movement patterns of the first furniture part, including a specific movement pattern if the first furniture part collides with an object, and then uses this specific movement pattern as the basis for further monitoring of the movement of the first furniture part.

2. The device as claimed in claim 1, wherein the monitoring unit records a closing movement pattern of the first furniture part during a closing movement of the first furniture part if the first furniture part collides with an object, and then uses this closing movement pattern as the basis for further monitoring of the movement of the first furniture part.

3. The device as claimed in claim 1, wherein the monitoring unit uses a movement pattern of the first furniture part as the basis for distinguishing between a collision with an object and a deliberate stopping of the movement of the first furniture part by an operator.

4. The device as claimed in claim 1, wherein the monitoring unit evaluates signals, which can be detected by sensor means, in order to characterize the movement pattern of the first furniture part.

5. The device as claimed in claim 1, further comprising an incremental transmitter that generates pulses as a function of movement of the first furniture part, and wherein the monitoring unit evaluates the pulses from the incremental transmitter in order to record the movement pattern of the first furniture part.

6. The device as claimed in claim 5, wherein the monitoring unit distinguishes between a collision with an object and a deliberate stopping of the movement of the first furniture part by an operator, on the basis of a comparison of the recorded pulses from the incremental transmitter per unit time with a reference value.

7. The device as claimed in claim 1, wherein the monitoring unit stops the movement of the first furniture part after a collision of the moving first furniture part with an object.

8. The device as claimed in claim 1, wherein the monitoring unit decelerates the movement of the first furniture part after a collision with an object.

9. The device as claimed in claim 1, wherein the monitoring unit decelerates the movement of the first furniture part in order to stop the movement of the first furniture part when deliberately initiated by an operator.

10. The device as claimed in claim 1, wherein the drive unit and the monitoring unit cooperatively move the first furniture part to a predetermined position after a collision with an object.

11. The device as claimed in claim 10, wherein the monitoring unit stops the first furniture part after a collision with an object, and then the drive unit and the monitoring unit cooperatively move the first furniture part to the predetermined position after a defined time interval has elapsed.

12. The device as claimed in claim 1, wherein the monitoring unit stops the first furniture part after a collision with an object, and then the drive unit and the monitoring unit cooperatively move the first furniture part to a closed position relative to the second furniture part.

13. The device as claimed in claim 1, wherein the monitoring unit stops the first furniture part after a collision with an object, and then the drive unit and the monitoring unit cooperatively move the first furniture part to an open position relative to the second furniture part.

14. The device as claimed in claim 1, wherein after a collision with an object the drive unit and monitoring unit cooperatively move the first furniture part back through a predetermined movement distance in the opposite direction to the movement direction of the first furniture part before the collision, and then the monitoring unit stops the first furniture part.

15. The device as claimed in claim 1, wherein the monitoring unit stops the first furniture part within a predetermined movement distance if the first furniture part collides with an object during an opening movement of the first furniture part from the closed position.

16. The device as claimed in claim 1, wherein the monitoring unit associates a collision of the first furniture part with an object within a predetermined movement distance exclusively with a deliberate stopping of the movement which has been initiated by an operator.

17. A piece of furniture comprising the device as claimed in claim 1.

18. A device for controlling the movement of furniture parts which can be moved with respect to one another, comprising a drive unit by means of which a first furniture part can be moved in a driven manner relative to a second furniture part, and a monitoring unit for monitoring the movement of the first furniture part, wherein the monitoring unit records a movement pattern of the first furniture part when the first furniture part collides with an object, deduces the nature of the collision, and then uses the recorded movement pattern as the basis for further monitoring of the movement of the first furniture part.

* * * * *